US007305722B2

(12) United States Patent
Sha et al.

(10) Patent No.: US 7,305,722 B2
(45) Date of Patent: Dec. 11, 2007

(54) FACIAL WASHER

(75) Inventors: Yung-Jye Sha, Hsinchu (TW); Wen-Chin Liao, Jhubei (TW)

(73) Assignee: National Chiao Tung University, Hsinchu (TW)

( * ) Notice: Subject to any disclaimer, the term of this patent is extended or adjusted under 35 U.S.C. 154(b) by 0 days.

(21) Appl. No.: 11/325,416

(22) Filed: Jan. 5, 2006

(65) Prior Publication Data

US 2007/0061960 A1 Mar. 22, 2007

(30) Foreign Application Priority Data

Sep. 16, 2005 (TW) ..... 94132004 A

(51) Int. Cl.
*E03C 1/05* (2006.01)

(52) U.S. Cl. ..... 4/623; 4/620

(58) Field of Classification Search ..... 4/619, 4/620, 623–626, 541.1–541.6
See application file for complete search history.

(56) References Cited

U.S. PATENT DOCUMENTS 3,297,025 A * 1/1967 Jacuzzi ..... 601/157
3,375,532 A * 4/1968 Gellmann ..... 4/570
4,853,987 A * 8/1989 Jaworski ..... 4/541.6
5,076,500 A * 12/1991 Daniels ..... 239/587.4

FOREIGN PATENT DOCUMENTS

| | | |
|---|---|---|
| TW | 383351 | 10/1987 |
| TW | 534129 | 9/1991 |

* cited by examiner

*Primary Examiner*—Huyen Le
(74) *Attorney, Agent, or Firm*—Rosenberg, Klein & Lee

(57) ABSTRACT

A facial washer is disclosed to include a basin, which has a plurality of water outlets symmetrically arranged on the inside wall thereof at two opposite lateral sides, a plurality of adjustable jet nozzles, which are respectively mounted in the water outlets inside the basin for ejecting a respective stream of water, each having a fixed ball socket and a ball valve rotatably supported in the ball socket for guiding water out of the respective water outlet in the form of a stream of water, and a control device for controlling the supply of water to the adjustable jet nozzles.

7 Claims, 6 Drawing Sheets

FACIAL WASHER

BACKGROUND OF THE INVENTION

1. Field of the Invention

The present invention relates to a facial washing apparatus and more particularly, to a facial washer that enables the user to adjust water spray pattern automatically as well as manually.

2. Description of the Related Art

The fast development of the industry brings conveniences to our daily life, however it also brings pollution to the environment. Modern people face much pressure from the work. When returned home after work, one needs to immediately wash the wash and message the muscles of the face and then to get the body fully relaxed.

FIG. 1 shows a conventional facial washer for use to wash the face automatically. As illustrated, the facial washer comprises a basin 10, which has a plurality of jet nozzles 12 symmetrically arranged on the inside wall at two opposite lateral sides and an overflow vent 24 at a suitable location near the top, a water source 28 adapted to provide water to the basin 10 for enabling water to be forced out of the jet nozzles 12 to wash the user's face, a control box 18, which comprises a water gate valve 16 and a timer 14, a first water supply pipe 281 connected between the water source 28 and the water gate valve 16, a second water supply pipe 282 connected between the water gate valve 16 and the basin 10, a water pressure control valve 20 installed in the first water supply pipe 281, and two sensors 221 and 222 installed in the basin 10 at two opposite lateral sides. When the user's face is approaching the inside space of the basin 10, the sensors 221 and 222 are induced to send a signal to the control box 18 to open the water gate valve 16, enabling water to pass from the water source 54 through the water gate valve 16 to the basin 10 via the water supply pipes 281 and 282 and then to pass out of the basin 10 through the jet nozzles 221 and 222. Further, the water pressure control valve 20 controls the water pressure of the sprayed streams of water 28 coming out of the jet nozzles 221 and 222, and the timer 14 is set to control the water spraying time. This structure of facial washer eliminates the use of a water tap, and is a thoughtful design for old persons and children, preventing accidental impact. This design of facial washer can automatically control the water pressure and the water spraying time. However, the water ejecting angle of this structure of facial washer is not adjustable to fit users of different ages. Further, the user must keep the face approaching the sensors 221 and 222 so that the sensors 221 and 222 can be induced to open the water gate valve 16. When the user moves the face away from the sensors 221 and 222 over a predetermined distance during washing, the water gate valve 16 will be closed. It is not comfortable to constantly keep the face suspending in the basin 10 deeply during washing.

Therefore, it is desirable to provide a facial washer that eliminates the aforesaid drawbacks.

SUMMARY OF THE INVENTION

The present invention has been accomplished under the circumstances in view. It is one object of the present invention to provide a facial washer that is adjustable to change the water ejecting angle to fit different users. It is another object of the present invention to provide a facial washer that messages the face with ejected streams of water when washing the face. It is still another object of the present invention to provide a facial washer that can easily be actuated by the user.

To achieve these and other objects of the present invention, the facial washer comprises a basin, the basin having a plurality of water outlets symmetrically arranged on the inside wall thereof at two opposite lateral sides; a plurality of adjustable jet nozzles respectively mounted in the water outlets inside the basin for ejecting a respective stream of water, the adjustable jet nozzles each comprising a ball socket fixedly mounted in the respective water outlet, and a ball valve rotatably supported in the ball socket for guiding water out of the respective water outlet in the form of a stream of water; and control means adapted to control the supply of water to the adjustable jet nozzles. Further, the a control box connected between an external water source and the basin for guiding water from the external water source to the adjustable jet nozzles; a water gate valve adapted to control the supply of water from the water source to the adjustable jet nozzles; a timer adapted to control the period of the supply of water from the water source to the adjustable jet nozzles; a water pressure control valve adapted to control the pressure of water passing from the water source to the adjustable jet nozzles; and a sensor mounted on a middle part of a rear wall inside the basin for opening the water gate valve upon approaching of a part of a person. By means of the water pressure control valve, the user can control the pressure of ejected streams of water for massaging the face.

DETAILED DESCRIPTION OF THE INVENTION

Figure 1:
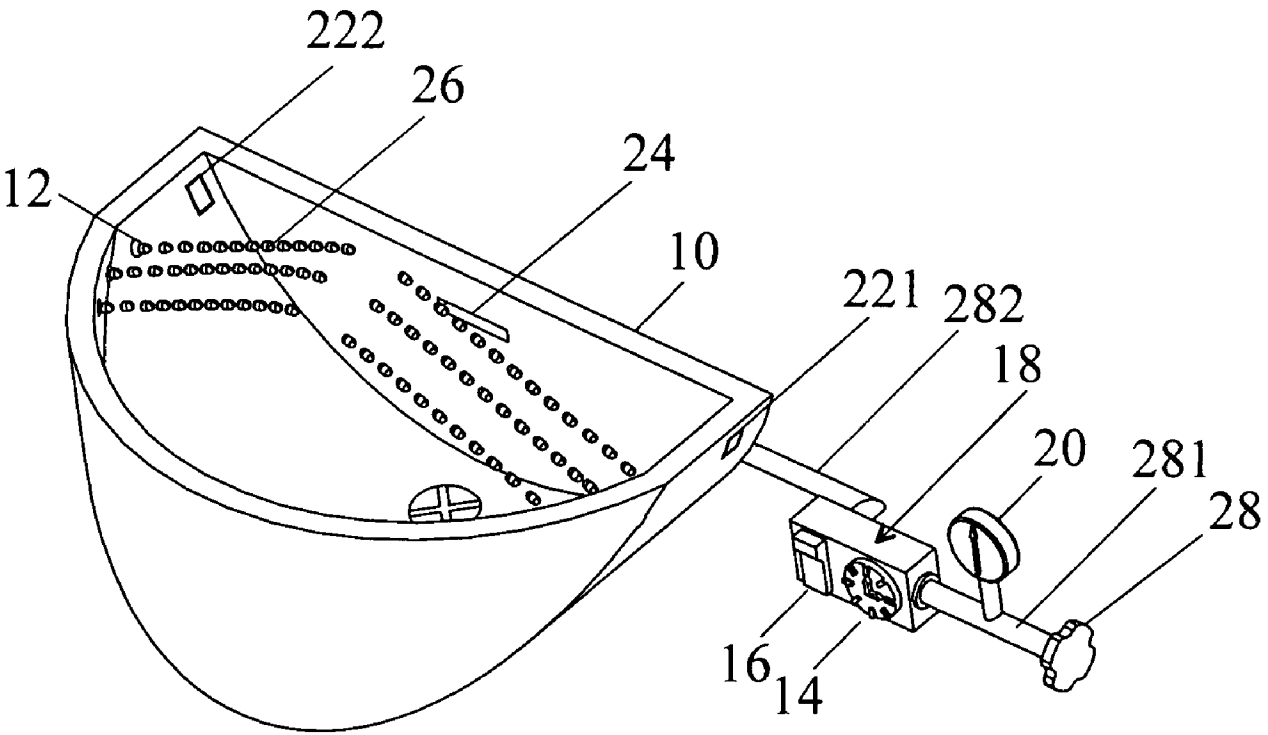
FIG.1(Prior Art)
FIG. 1 is a sectional view of a facial washer according to the prior art.
Figure 2:
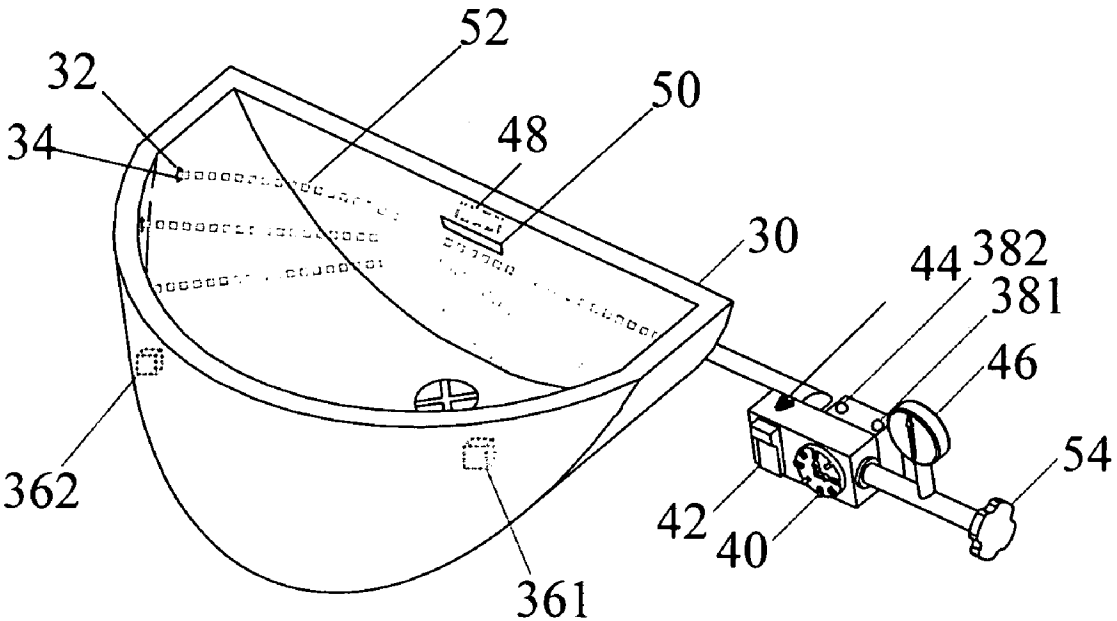
FIG. 2 is a sectional view of a facial washer according to the present invention.

Referring to FIGS. 1 and 2, a facial washer in accordance with the present invention is shown comprising a basin 30. The basin 30 has two sets of water outlets 32 symmetrically arranged on the inside wall at two opposite lateral sides, an overflow vent 50 disposed near the top. According to this embodiment, there are three water outlets 32 at each side. Further, an adjustable jet nozzle 34 is respectively installed in each water outlet 32.

Figure 3:
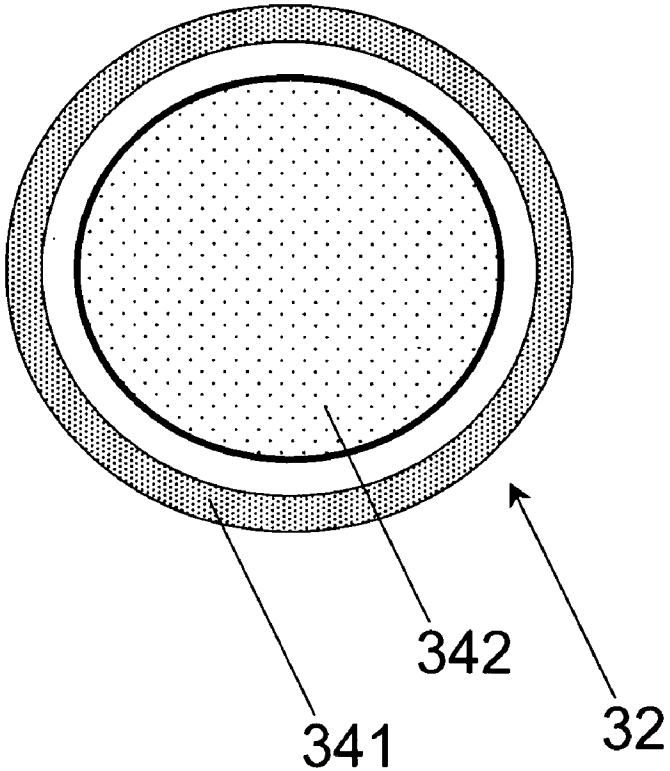
FIG. 3 is a cross-sectional view of an adjustable jet nozzle according to the present invention.
Figure 4:
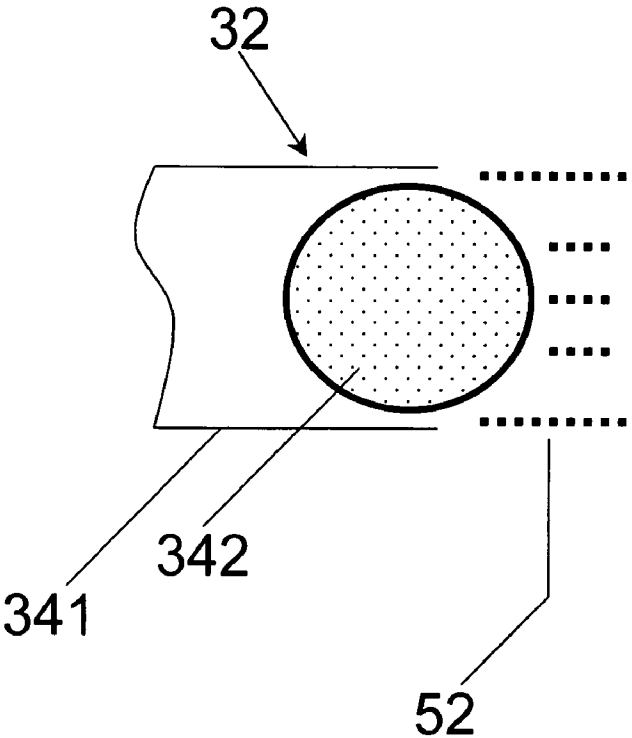
FIG. 4 is a schematic drawing showing the adjustable jet nozzle in action according to the present invention.
Figure 5:
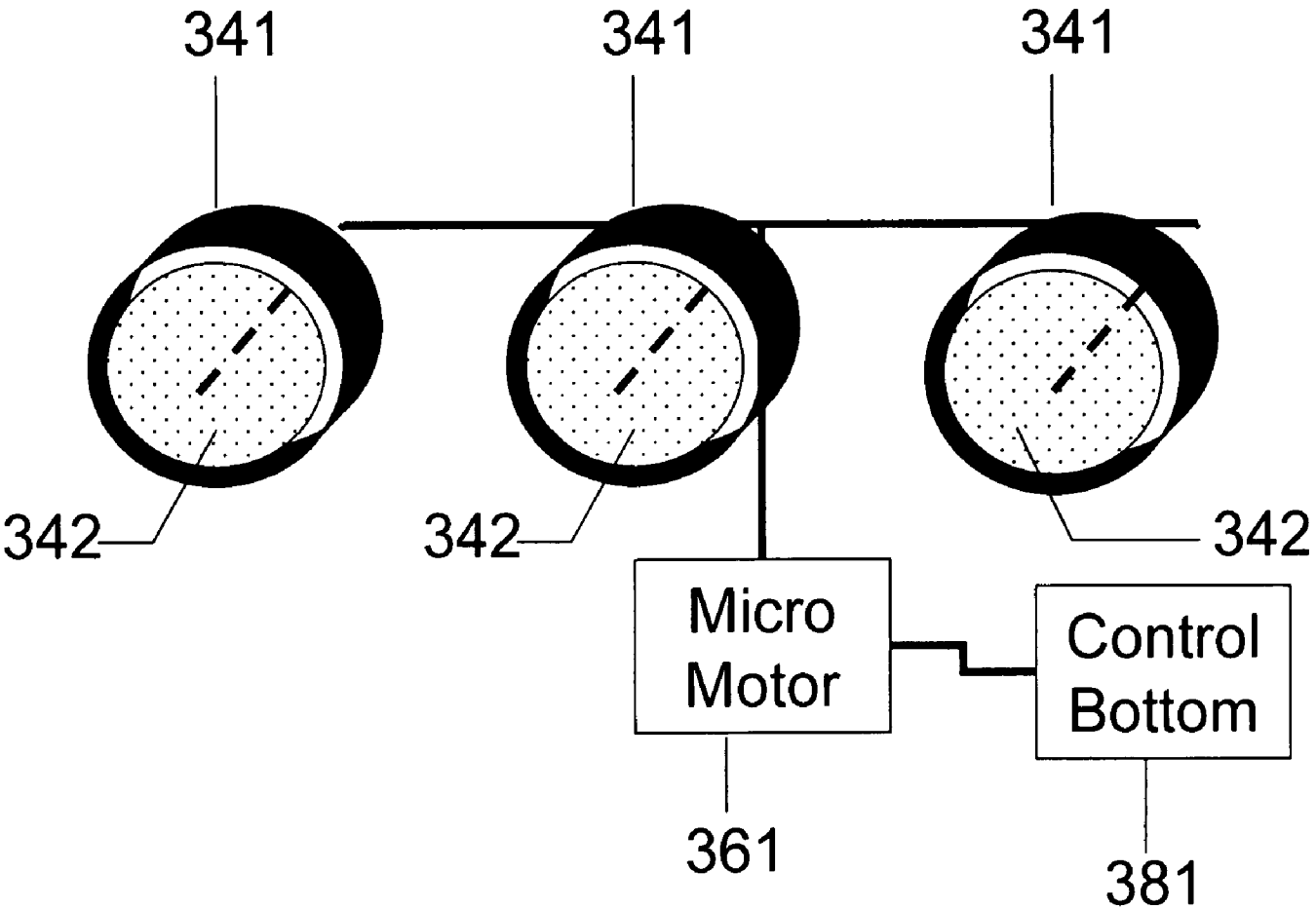
FIG. 5 is a schematic control circuit block diagram, showing multiple adjustable jet nozzles coupled to one single micro motor and one single control button according to the present invention.

Referring to FIGS. 3~5 and FIG. 2 again, each adjustable jet nozzle 34 comprises a ball socket 341 and a ball valve 342 rotatably mounted in the ball socket 341. Further, two micro motors 361 and 362 are mounted in the basin 30 and respectively coupled to the ball valves 342 of the two sets of adjustable jet nozzles 34 and adapted to turn the ball valves 342 relative to the respective ball sockets 341 to further adjust the respective ejecting angle of the ejected streams of water 52 from the adjustable jet nozzles 34. The user can also turn the ball valve 342 of each adjustable jet nozzle 34 to the desired angle manually.

Referring to FIG. 2 again, the facial washer further comprises a control box 44 connected between a water source 54 and the basin 30, and a sensor 48 mounted in the basin 30 on the middle of the wall mounting side of the basin 30 near the top. The control box comprises a water gate valve 42 and a timer 40, a water pressure control valve 46, and two control buttons 381 and 382. Through the control buttons 381 and 382, the user can switch on/off the micro motors 361 and 362 respectively. When the user's hand or head approaching the sensor 48, the sensor 48 is induced to open the water gate valve 42, for enabling water to pass from the water source 54 to the adjustable jet nozzles 34 through the water pressure control valve 46. The user can set the timer 40 to control the ejecting time of the ejected streams of water 52 from the adjustable jet nozzles 34. The water pressure control valve 46 is adapted to control the pressure of water passing from the water source 54 to the adjustable jet nozzles 34.

Figure 6:
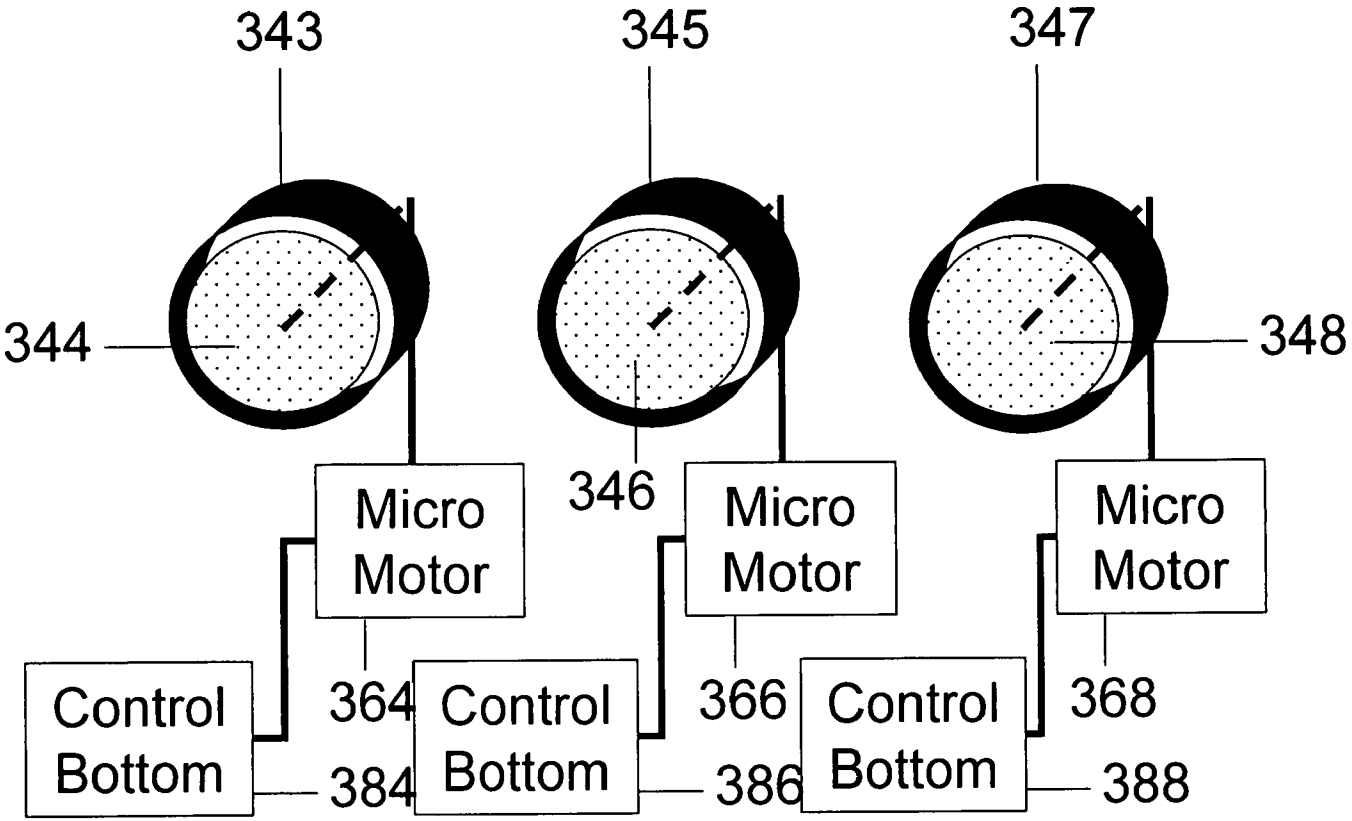
FIG. 6 is a schematic control circuit block diagram, showing multiple adjustable jet nozzles respectively coupled to respective micro motors and respective control buttons according to the present invention.

According to the present invention, one single micro motor can be used to control the ball valves of multiple adjustable jet nozzles. Alternatively, one single micro motor can be set to control only one adjustable jet nozzle. As shown in FIG. 6 the respective control buttons 384, 386 and 388 to rotate respective ball valves 344, 346 and 348 in respective ball sockets 343, 345 and 346 respectively control respective micro motors 364, 366 and 368.

As indicated above, the invention provides a facial washer that allows the user to adjust the ejecting angle of the ejected streams of water 52 from each adjustable jet nozzle 34 automatically as well as manually. Further, the facial washer has the sensor installed in the rear wall on the inside on the middle to sensitively control the operation of the water gate valve upon approaching of the user's hand or head.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A facial washer comprising:

a basin, said basin having a plurality of water outlets symmetrically arranged on an inside wall thereof at two opposing lateral sides;

a plurality of adjustable jet nozzles respectively mounted in said water outlets inside said basin for ejecting a respective stream of water, said adjustable jet nozzles each having a ball socket fixedly mounted in the respective water outlet, and a ball valve rotatably mounted in said ball socket for guiding water out of the respective water outlet in the form of a stream of water; and control means adapted to control the supply of water to said adjustable jet nozzles and having at least one micro motor adapted to rotate the ball valves of said adjustable jet nozzles in the respective ball sockets.

2. The facial washer as claimed in claim 1, wherein said control means comprises:

a control box connected between said external water source and said basin for guiding water from said external water source to said adjustable jet nozzles;

a water gate valve adapted to control the supply of water from said water source to said adjustable jet nozzles;

a timer adapted to control the period of the supply of water from said water source to said adjustable jet nozzles; and a water pressure control valve adapted to control the pressure of water passing from said water source to said adjustable jet nozzles; and wherein said sensor opens said water gate valve when motion is detected by said sensor.

3. The facial washer as claimed in claim 1, wherein said at least one micro motor is respectively mounted inside said basin and coupled to the ball valves of said adjustable jet nozzles.

4. The facial washer as claimed in claim 1, wherein said control means further comprises at least one control button adapted to control the operation of said at least one micro motor.

5. The facial washer as claimed in claim 4, wherein the number of said at least one micro motor is 2, and the two micro motors are symmetrically mounted in said basin at two sides; the number of said at least one control button is 2, and the two control buttons are respectively electrically coupled to the two micro motors.

6. The facial washer as claimed in claim 4, wherein the number of said at least one micro motor and the number of said at least one control button are equal to the number of said adjustable jet nozzles.

7. The facial washer as claimed in claim 4, wherein said at least one control button is respectively installed in said control box.

* * * * *